US007246764B2

(12) United States Patent
Planck et al.

(10) Patent No.: US 7,246,764 B2
(45) Date of Patent: Jul. 24, 2007

(54) CROSS-WOUND BOBBIN

(75) Inventors: Heinrich Planck, Nurtingen (DE); Christoph Rietmuller, Leonberg (DE); Helmut Weinsdorfer, Pliezhausen (DE)

(73) Assignee: Deutsch Institute fur Textil-und Faserforschung Stuttgart (DITF), Denkendorf (DE)

( * ) Notice: Subject to any disclaimer, the term of this patent is extended or adjusted under 35 U.S.C. 154(b) by 0 days.

(21) Appl. No.: 10/467,035

(22) PCT Filed: Jan. 25, 2002

(86) PCT No.: PCT/DE02/00250

§ 371 (c)(1),
(2), (4) Date: Jan. 8, 2004

(87) PCT Pub. No.: WO02/060800

PCT Pub. Date: Aug. 8, 2002

(65) Prior Publication Data

US 2004/0104290 A1 Jun. 3, 2004

(30) Foreign Application Priority Data

Feb. 1, 2001 (DE) ..... 101 04 463

(51) Int. Cl.
*B65H 55/04* (2006.01)

(52) U.S. Cl. ..... 242/178

(58) Field of Classification Search ..... 242/175, 242/174, 176, 177, 178, 477.6
See application file for complete search history.

(56) References Cited

U.S. PATENT DOCUMENTS

| | | | | |
|---|---|---|---|---|
| 1,647,535 | A * | 11/1927 | McKean | 242/174 |
| 2,267,983 | A * | 12/1941 | Lovett | 242/176 |
| 2,539,942 | A * | 1/1951 | Beeftink | 242/470 |
| 2,764,368 | A * | 9/1956 | Halkyard et al. | 242/177 |
| 4,049,211 | A * | 9/1977 | Spescha | 242/413.9 |
| 4,586,679 | A * | 5/1986 | Yamamoto et al. | 242/176 |
| 4,798,347 | A * | 1/1989 | Schippers et al. | 242/485.9 |
| 4,986,483 | A * | 1/1991 | Ryu et al. | 242/413.9 |
| 6,276,624 | B1 * | 8/2001 | Endo et al. | 242/174 |

FOREIGN PATENT DOCUMENTS

| | | | |
|---|---|---|---|
| DE | 4142886 | A1 * | 7/1992 |
| DE | 4313113 | * | 10/1993 |
| JP | 61051465 | A * | 3/1986 |

OTHER PUBLICATIONS

Translation of JP 61051465 A.*

* cited by examiner

*Primary Examiner*—Patrick Mackey
*Assistant Examiner*—William E. Dondero
(74) *Attorney, Agent, or Firm*—Leydig, Voit & Mayer, Ltd

(57) ABSTRACT

In a cross-wound bobbin (1), the helical lines along which the yarn (4) is wound have a different inclination in adjacent layers. The winding ratios are selected such that the quantity drawn off is greater if the unwinding point is moving from the unwinding end to the bottom end, compared to the quantity drawn off if the unwinding point is moving from the bottom end to the unwinding end.

17 Claims, 5 Drawing Sheets

CROSS-WOUND BOBBIN

FIELD OF THE INVENTION

This invention relates to cross-wound bobbins for yarn-using machines such as weaving or knitting machines.

BACKGROUND OF THE INVENTION

Cross-wound bobbins, also called cheeses or cheese packages, are supply bobbins from which a yarn is unwound and delivered to a yarn-using machine, such as a weaving machine or knitting machine. The cheese cone of the cross-wound bobbin is self-supporting and does not require end plates on the face ends. The hold within the cheese cone is achieved because the yarn or thread is wound up helically at a relatively high pitch traverse, rather than with windings close together as in a flanged bobbin with walls on the ends. The pitch traverse of the helical lines is high in order that the yarn in the individual layers of yarn will intersect multiple times, thus stabilizing the layer of yarn beneath it. At the same time, it forms an enveloping surface for the layer underneath.

The angle of inclination or crossing angle at which the yarns in the individual layers intersect prevents the yarns from forcing their way in between individual windings in the layer underneath, as would happen in a parallel-wound bobbin. On the face ends of the cheese cone, the yarn makes the transition from one layer to the next, or from one helical line to the other, at a turning point. The turning points at the two face ends constantly change their location within the cheese cone, in order to stabilize the face ends.

Free access to at least one face end of the cross-wound bobbin is needed to allow the yarn to be drawn off from the top, that is, overend. In overend unwinding, the cross-wound bobbin itself remains stationary. The yarn is unwound from the top of the stationary cross-wound bobbin through a yarn eye. The yarn eye is at a distance from the unwinding end of the cross-wound bobbin and is located on the axis of symmetry of the cross-wound bobbin.

From German patent disclosure DE 41 42 886, one such cross-wound bobbin is known in which the pitch traverse differs in the various layers. That is, the inclination of the helical line that the yarn in one layer forms differs quantitatively from the inclination of the helical line in the yarn layer either above or beneath it.

The differing inclination is intended to solve one problem in unwinding the cross-wound bobbin. If the angles of inclination are the same, the yarn can tend to catch at the crossing points, which impairs the unwinding capability. This adhesion increases the unwinding force abruptly, to the point of an overload on the yarn and consequent yarn breakage.

For producing the known cross-wound bobbin, a traversing device is used, which operates at a variable reciprocation speed. The cross-wound bobbin produced is wound up in such a way that the yarn quantity upon unwinding is less if the unwinding point of the yarn on the outside of the cheese cone is moving from the unwinding end to the bottom end, compared to the yarn quantity drawn off if the unwinding point is moving in the opposite direction.

Modern textile machines and especially weaving machines have attained a speed that is limited by the delivery speed of the yarn.

SUMMARY OF THE INVENTION

The present invention provides a cross-wound bobbin having a bobbin core and a cheese cone. The cheese cone is made-up of yarn that is applied in layers to the bobbin core. The cheese cone has an unwinding end from which the yarn can be drawn off over end and a bottom end. The yarn in the cheese cone extends along a first helical line from the unwinding end to the bottom end and in a second helical line in the opposite winding direction from the bottom end to the unwinding end. The inclinations of the first and second helical lines are different from each other such that in at least one region of the cheese cone the yarn being unwound is greater if the unwinding point of the yarn on the outside of the cheese cone has moved from the unwinding end to the bottom end of the cheese cone than the yarn length that is drawn off in this region if the unwinding point has moved from the bottom end of the cheese cone to the unwinding end.

DETAILED DESCRIPTION OF THE INVENTION

Figure 1:
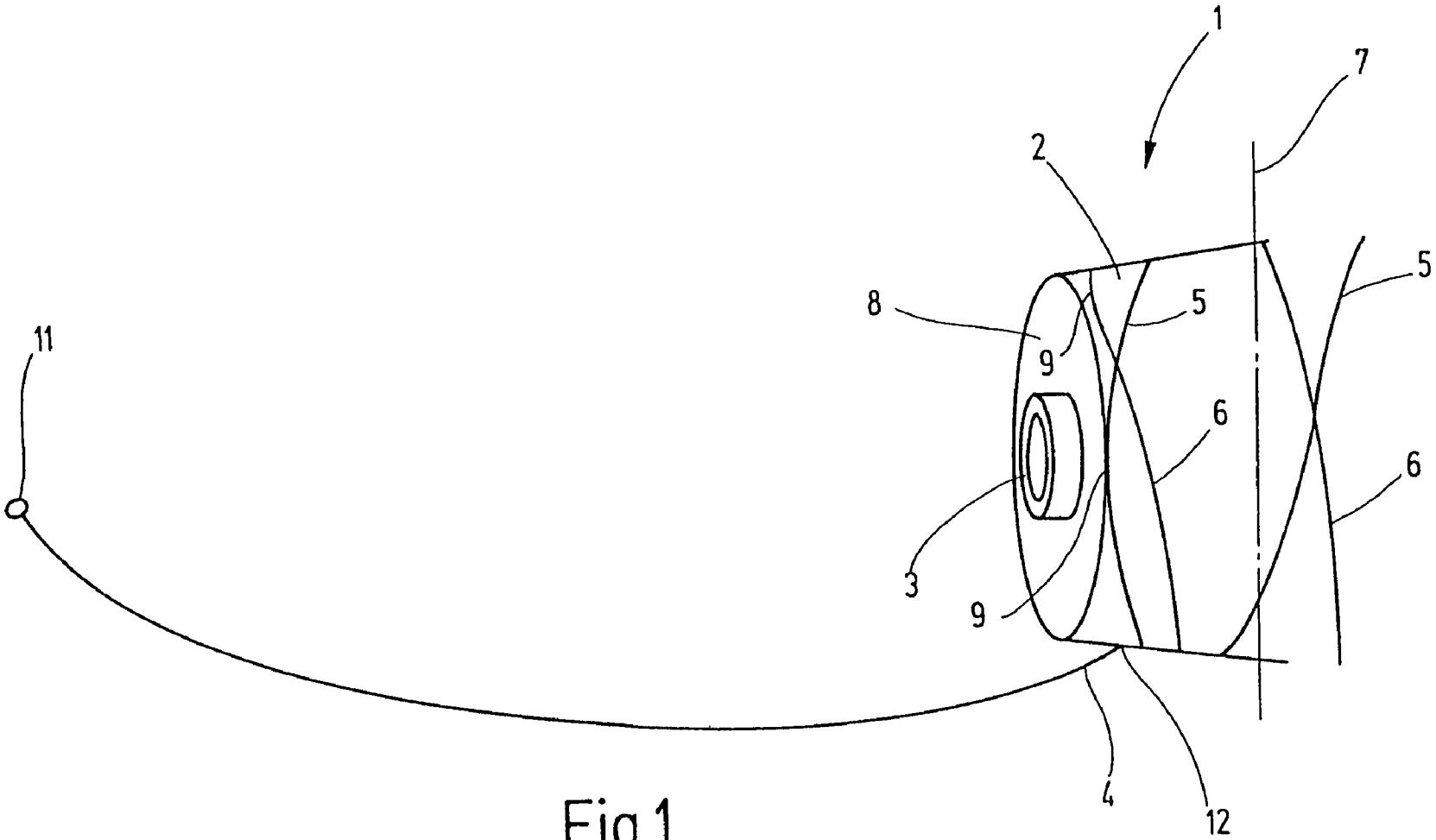
FIG. 1 is a schematic perspective view of a prior art cross-wound bobbin.

FIG. 1 schematically illustrates the conditions involved in unwinding a known cross-wound bobbin 1. The cross-wound bobbin 1 comprises a cheese cone 2, which is wound onto a tubular bobbin tube 3. A thread or yarn 4 forms the cheese cone 2. The yarn 4 is wound in layers of windings with the aid of a known traversing device. Two of these layers are shown schematically and in part. The yarn is indicated in one layer by reference numeral 5 and in the other layer by reference numeral 6. For instance, let layer 5 be the layer or winding located farther inward, while the layer 6 or winding is located radially farther outward. In one layer, such as layer 5, the windings of the yarn 4 form a counterclockwise helix, while in the windings of yarn in layer 6 form a clockwise helix. The angles of inclination at which the yarn 5 is wound are quantitatively relatively large, compared to a plane 7 located perpendicular to the longitudinal axis of the bobbin tube 3. That is, the height of inclination of the helixes that the layers 5 and 6 form is multiple times larger than the thickness of the yarn 4. In this way, the windings of one layer are prevented from being able to force their way into the other layer and forcing the windings of that layer apart.

The cross-wound bobbin 1 obtained in this way forms an unwinding end 8 that is an essentially plane annular face. Turning points 9, where the yarn course changes from one layer to the next and thus from one helical line to the helical line in the opposite direction, are located in the region of the unwinding end. The turning points 9 in the region of the unwinding end are distributed as randomly as possible, or more specifically are randomly distributed in both the circumferential direction and, with a certain range of deviation, in the axial direction. These provisions are intended on the one hand to attain effective stabilization of the unwinding end and on the other to avert an agglomeration of material.

The foot end is located on the other axial end of the cross-wound bobbin 1 and is built up in the same way as the unwinding end 8 that can be seen in FIG. 1.

From the outer circumferential surface of the cross-wound bobbin 1, the yarn 4 is drawn off through an eye 11, which is axially spaced apart from the cross-wound bobbin 1 and is located on the axis of symmetry. The yarn eye 11 is fixed in space. The cross-wound bobbin 1 is likewise unmoving while the yarn is being drawn off.

Because of the adhesion of the yarn to the effective surface of the bobbin, a defined unwinding point 12 develops, beyond which the course of the yarn, in the travel direction of the yarn 4 during unwinding, no longer corresponds to the yarn course inside the cross-wound bobbin 1. The unwinding point 12 circulates in the circumferential direction along the helical line that the yarn 4 forms on the outside of the cheese cone 2 at the time, and at the same time the unwinding point 12 moves in the longitudinal direction of the cross-wound bobbin 1.

The speed at which the unwinding point 12 circulates in the circumferential direction, or in other words its angular speed, depends on the yarn unwinding speed and on the diameter of the cheese cone 2. The greater the diameter of the cheese cone 2 and the lower the unwinding speed, the lower is the angular speed at which the unwinding point 12 rotates. Conversely, the angular speed increases if, at a constant unwinding speed, the winding diameter has decreased because of increasing yarn consumption.

Because the unwinding point 12 rotates about the circumference of the cheese cone 2, the yarn segment between the yarn eye 11 and the unwinding point 12 rotates about the imaginary axis that is defined by the yarn eye 11 and the axis of symmetry of the cheese cone 2. The rotation generates a centrifugal force that tends to push the drawn-off length of yarn radially outward.

While the cheese cone is still full, the circulation speed of the unwinding point 12 of the yarn 4 from the top end of the cheese cone 2, for a given yarn consumption rate, is still relatively slight. The incident centrifugal force is insufficient to unwind the yarn 4, immediately adjacent to the unwinding point 12, from the top end of the cheese cone 2. On the far side of the unwinding point 12, the yarn 4 will first slide over the top end of the cheese cone 2, before reaching open space after moving past the unwinding end 8.

In space, the freely floating length of yarn defines a surface of revolution whose apex is located at the yarn eye 11. The generatrix of this surface of revolution is the freely floating length of yarn itself, which describes a complicated three-dimensional curve. This freely floating length of yarn is engaged not only by centrifugal force but also by air resistance, so the yarn course is not a simple line located in one plane. The volume defined by the freely floating length of yarn is known as a yarn balloon.

As consumption increases, the outer diameter of the cheese cone 2 decreases. Since the yarn unwinding speed remains constant, the unwinding point 12 must circulate faster, to compensate for the reduction in yarn length along the circumference that is due to the reduction in diameter.

Beyond a certain angular speed, the centrifugal force will be high enough to lift the yarn 4 from the top end of the cheese cone 2 immediately adjacent to the unwinding point 12.

The adhesion of the yarn 4 to the layers of yarn beneath it, irregularities in the air resistance of the yarn caused by structural changes, fluctuations in yarn tension, and still other such factors, mean that in a range of angular speed of the unwinding point 12, the unwinding conditions will constantly alternate between sliding on the surface of the cheese cone 2 and floating above the surface. The inventors have determined that this alternation back and forth between the two unwinding situations is also influenced by whether the unwinding point 12 is moving away from the unwinding end 8, or toward the unwinding end 8.

If the unwinding point 12 is moving away from the unwinding end 8, the circulation speed and thus also the centrifugal force increase, resulting in a tendency for the yarn 4 immediately adjacent to the unwinding point 12 to come loose from the top end of the cheese cone 2 and float freely above the surface. Conversely, if the unwinding point 12 is moving toward the unwinding end 8, the circulation speed and the centrifugal force decrease, so that the yarn 4 instead has the tendency to slip over the top end.

The effects of air resistance on the top end of the cheese cone 2 will also have a corresponding influence in this respect.

Not until the angular speed of the unwinding point has increased still further will a changeover to the unwinding situation in which the yarn slides above the surface no longer occur.

The progressive yarn consumption causes the diameter of the cheese cone 2 to shrink increasingly and causes the angular speed of the unwinding point 12 to increase further. The greater speed of the yarn in the air causes the single balloon that initially forms to become a so-called double balloon, with two clearly recognizable balloon portions joined to one another by a narrow constriction. The course of the floating length of yarn in this situation is shown in FIG. 2.

Figure 2:
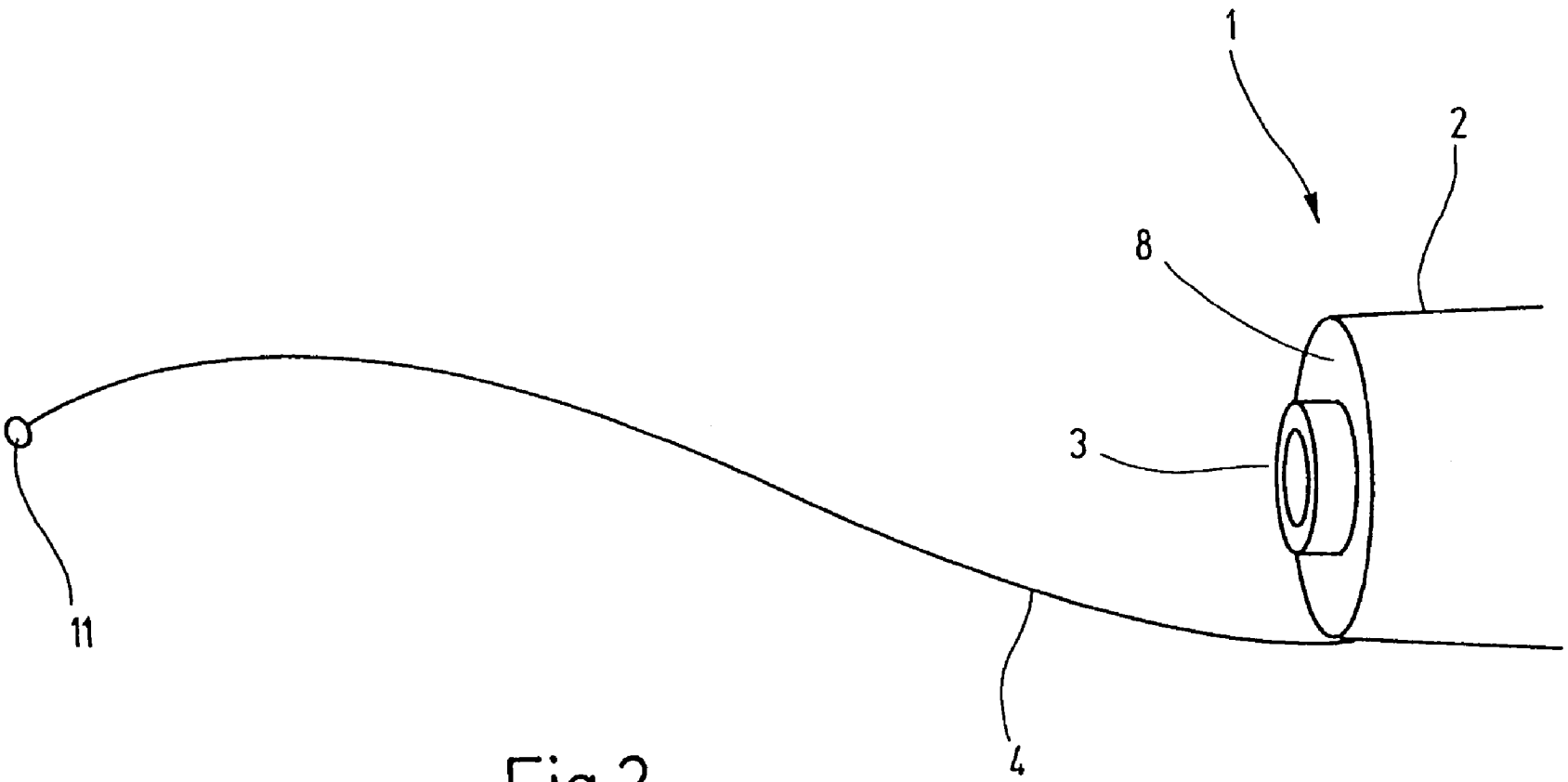
FIG. 2 is a schematic perspective view of the cross-wound bobbin of FIG. 1 with a yarn course having a double balloon.

The transition from the situation shown in FIG. 1 to the situation shown in FIG. 2 likewise takes place in a range in which there is constant alternation between the conformation of FIG. 1 and the conformation of FIG. 2. Not until beyond a certain angular speed will the conformation of FIG. 2 develop exclusively.

Figure 3:
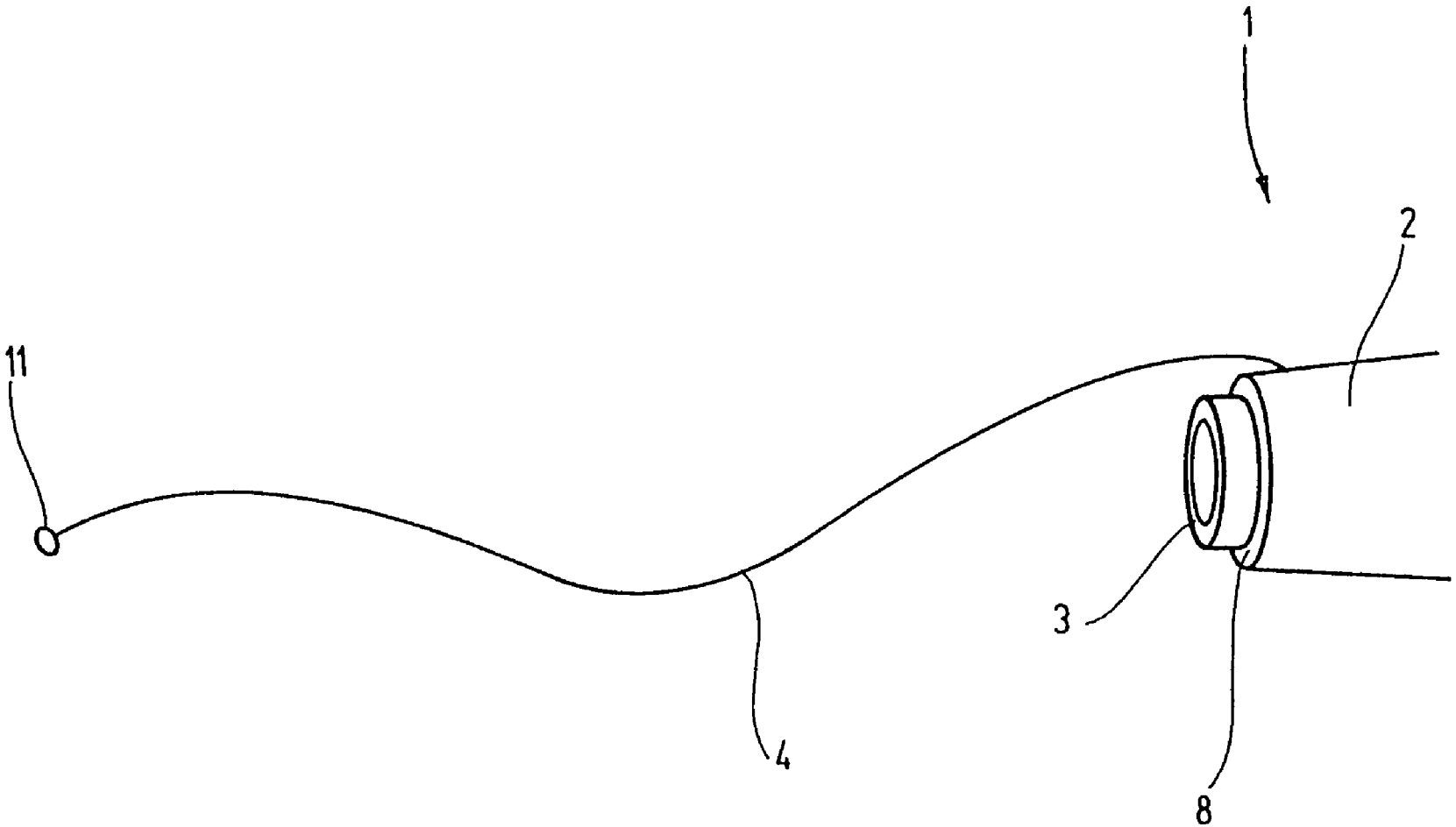
FIG. 3 is a schematic perspective view of the cross-wound bobbin of FIG. 1 with a yarn course having a triple balloon.

At a very low package diameter, finally, a triple yarn balloon is created, with two recognizable constrictions. The yarn course associated with this triple balloon is shown in FIG. 3. The transition from the conformation of FIG. 2 to the conformation of FIG. 3 also extends over an angular speed range in which the balloon alternates constantly between being double and triple. Different forces and yarn tensions that occur in the yarn are certainly associated with the various types of balloon.

The strength of a yarn has a bell-curve distribution around a mean tensile strength value. Because of the deviation in the strength values, there are some segments in the yarn that have a markedly higher breaking strength and conversely other segments that already break at markedly lesser forces.

In turn, the yarn-using apparatus certainly does not generate a single constant force; on the contrary, its force will also be distributed in a bell curve. Yarn breaks are to be expected in the range in which the gaussian curve of the force that actually occurs overlaps the strength distribution of the yarn, or in other words, the range in which the two gaussian curves overlap. The larger the area of overlap, the greater the likelihood that the yarn will break on the yarn-using side, which accordingly leads to machine down times.

One quite critical place that the yarn must travel through from the cross-wound bobbin to the finished textile article is the unwinding from the bobbin 1 itself.

Figure 4:
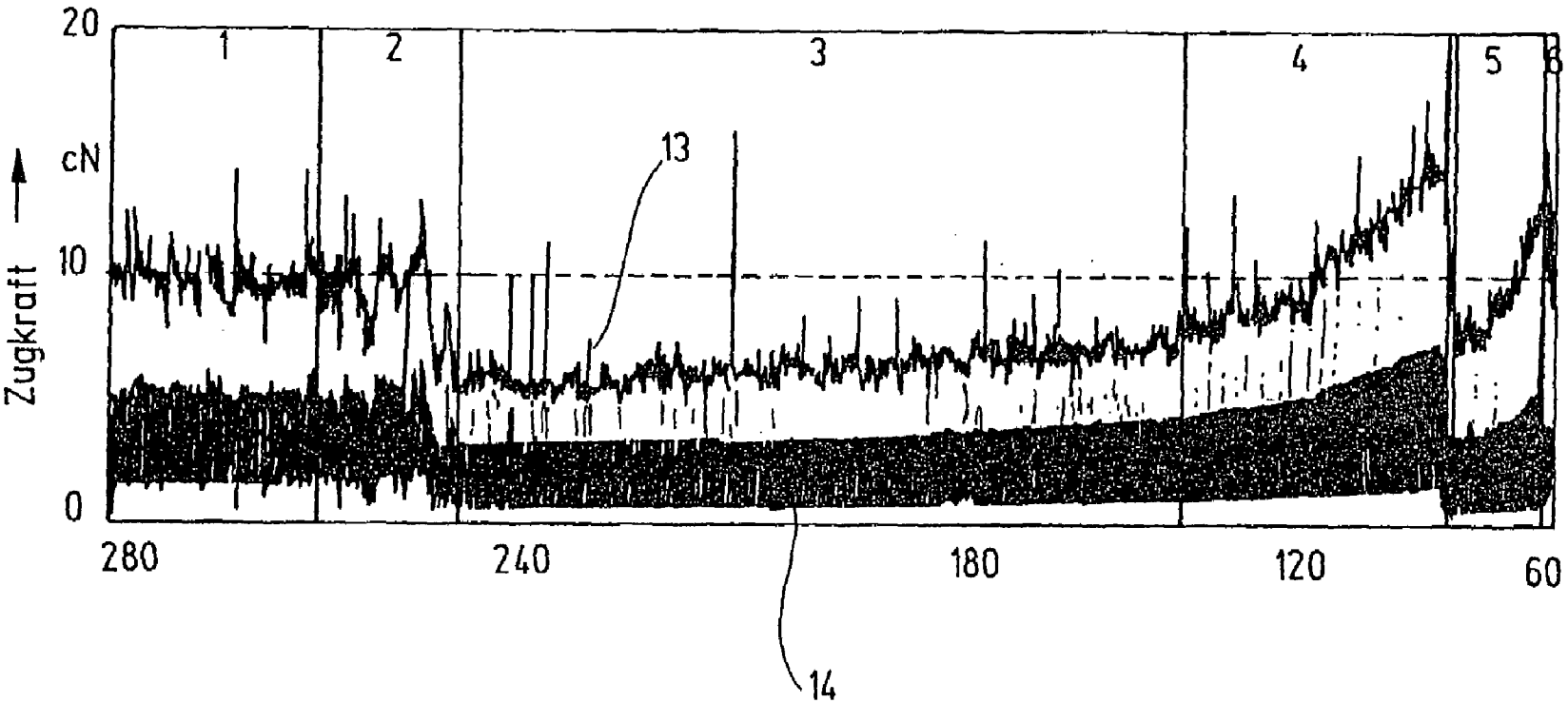
FIG. 4 is a graph showing the yarn tension plotted over the package diameter of the cross-wound bobbin.

FIG. 4 shows the course of yarn tension, plotted over the package diameter of the cross-wound bobbin 1. The unit of measurement for the package diameter is millimeters, and the unit of measurement for the tensile force is cN (grams). A severely zigzagging upper curve 13 represents the course of the maximum incident force, in each case per 100 measured values. Below it is a dark-colored tubular or bandlike range 13, which represents the statistical standard deviation in the measured tensile force values. The statistical mean value of the incident tensile force is located approximately in the middle of this band. The graph is divided longitudinally into zones, numbered from 1 to 6.

The unwinding of the yarn 4 from the cross-wound bobbin 1 begins at the maximum diameter of the cross-wound bobbin if approximately 280 mm. At this diameter, the angular speed of the unwinding point 12 is too low for the centrifugal force to cause the yarn to come loose from the top end of the cross-wound bobbin 1 directly at the unwinding point 12. In this operating situation, the yarn 4 slides over the surface and generates comparatively quite high maximum tensile stresses, even though the mean value is relatively low, and the standard deviation is not excessively high either, as the band 14 shows. The high maximum tensile stresses are due above all to the fact that the yarn 4 that is sliding on the surface catches on the yarn over which it is sliding, since the yarn surface itself is not smooth. Individual fibers protrude from it.

The operating situation in which the yarn slides persists in its pure form until a package diameter of approximately 260 mm.

Below about 260 mm, that is, at the transition between the zones marked 1 and 2 in the graph, the unwinding situation in which the yarn 4 comes loose from the top end immediately adjacent to the unwinding point 12 will sporadically occur. In the ranges in which the balloon has already formed from the unwinding point 12 on, the maximum unwinding force drops abruptly, and then immediately rises again once the balloon forms, which is only adjacent to the unwinding end 7. In zone 2, very great fluctuations in the maximum unwinding force and also relatively great fluctuations in the range of the standard deviation can therefore be observed.

As the diameter reduction progresses further, or in other words to the right of zone 2, the balloon adjacent to the unwinding point 12 remains stable. Unwinding with sliding no longer occurs. The maximum incident tensile force decreases abruptly. The standard deviation becomes less, and the mean value also drops. Clearly, to the right of zone 2, the yarn 4 being unwound is mechanically much less heavily loaded. The likelihood of yarn breakage is reduced significantly.

Down to a diameter of about 160 mm, that is, within zone 3, conditions remain stable, and the yarn tension rises only slowly. The increase in yarn tension can be ascribed to the higher rotational speed and the attendant greater load from air resistance and the greater mass of yarn located in the balloon.

To the right of zone 3, a pronounced increase in the maximum tensile tress and also in the mean value can be observed. The balloon now assumes even greater dimensions, which lead to higher tensile stresses because of higher centrifugal force. A randomly distributed alternation between the single balloon and the double balloon also occurs. Toward the end of zone 4, finally, the situation finally switches over in favor of the double balloon, whereupon the centrifugal forces abruptly drop, and hence so do the tensile stresses. Both the standard deviation and the maximum stresses that occur, that is, the exceptional stresses in the direction of very high values, also decrease abruptly. At the end of zone 5, at a diameter of less than 60 mm, finally, a change to a triple balloon can be observed. At the end of zone 5, the maximum force again rises relatively sharply, and then abruptly collapses, once the triple balloon has developed to a steady state.

With the above as the point of departure, it is the object of the invention to create a cross-wound bobbin that is suitable for quantitatively reducing the maximum tensile stresses that occur in the yarn and/or limiting them to a reduced operating range, in order to lessen the likelihood of yarn breakage.

In the cross-wound bobbin of the invention, the individual layers are wound with a different inclination of the helical lines. They are wound in such a way that the yarn length drawing off is greater if the unwinding point is moving from the unwinding end to the bottom end, compared to the yarn length that is drawn off if the unwinding point is moving from the bottom end to the unwinding end. In other words, the helix along which the unwinding point moves from the top end to the bottom end has a markedly lesser inclination than the helical line along which the unwinding point moves from the bottom end toward the top end. Because of this provision, the unfavorable influence on the balloon that is due to the fact that the unwinding point moves away from the yarn balloon at relatively high speed, can be reduced. Because of the lesser inclination of the helical line as the unwinding point moves away from the balloon, the axial speed of the unwinding point away from the balloon is reduced markedly, and the unfavorable influence on the balloon formation is lessened.

At smaller diameters, the cross-wound bobbin of the invention shows the transition to the double balloon more clearly, which as explained above is more favorable in terms of the maximum incident stress. Once again, the diameter range over which switching back and forth between the single and the double balloon occurs is reduced markedly. Smaller ranges correspondingly lessen the likelihood of yarn breakage.

If sliding unwinding occurs, the constant fluctuation between sliding yarn unwinding and freely floating yarn unwinding in the cross-wound bobbin of the invention is reduced to a very much smaller diameter range.

Compared with the prior art, a steady floating balloon that begins at the unwinding point will already develop at very much greater outer diameters of the cheese cone.

In both cases, the invention makes a higher unwinding speed possible.

By a suitable free choice of the pitch traverses of the helical lines within the cheese cone, it is possible within certain limits to control when the switchover to the respectively other type of unwinding or conformation of the balloon occurs, or in other words when the change from the sliding unwinding to the free-floating unwinding after the unwinding point irreversibly occurs, or when the double balloon or the triple balloon irreversibly occurs.

Figure 5:
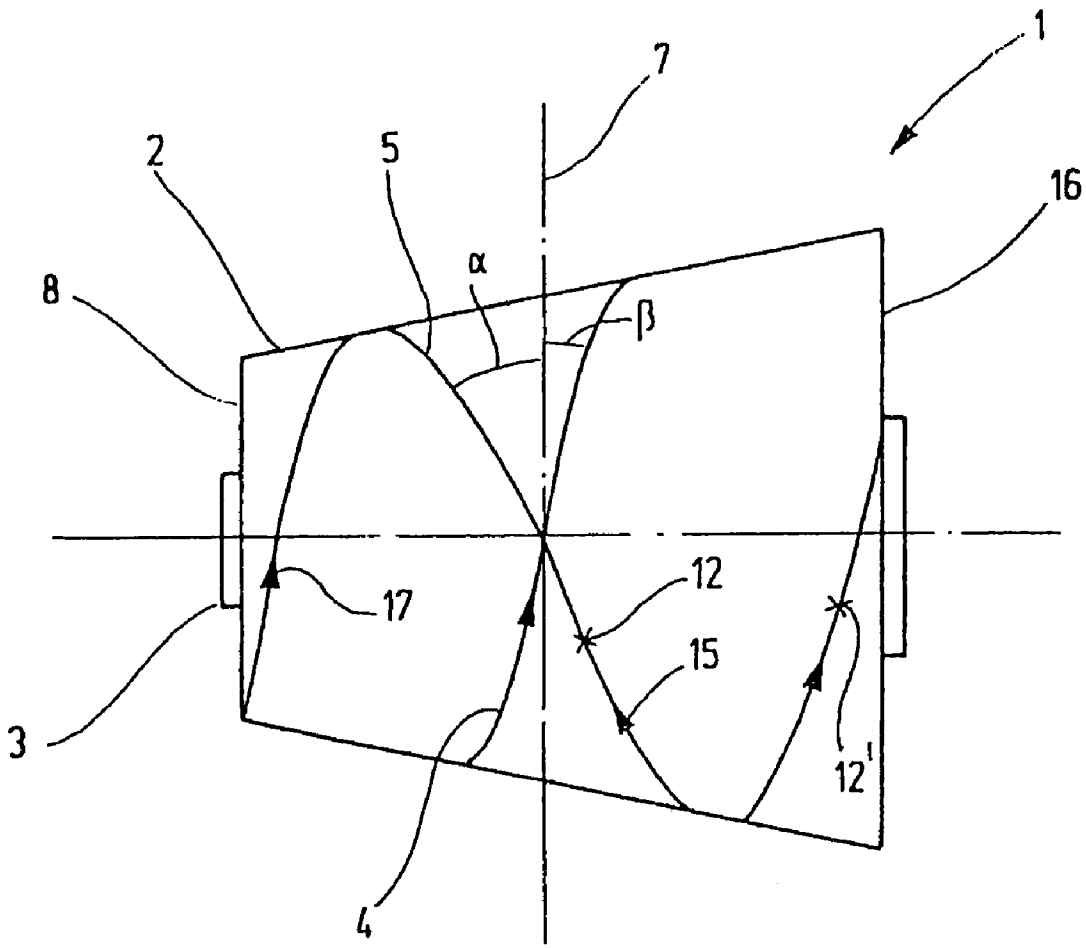
FIG. 5 is a schematic side elevation view of an illustrative bobbin according to the present invention.

In FIG. 5, the cross-wound bobbin 1 of the invention is shown highly schematically.

The cross-wound bobbin 1 of the invention has the same basic makeup as the cross-wound bobbin 1 of the prior art. It has a bobbin tube 3 on which the cheese cone 2 is applied. The course of the yarn on the top end of the cheese cone 2 is shown schematically. In unwinding, the indicated takeoff point 12 moves in the upper visible yarn layer in the direction of an arrow 15 from the bottom end 16 to the unwinding end or top end 8. The layer forms a clockwise helix. As soon as the upper visible layer has been removed, the unwinding point 12 changes to the layer beneath it, where the unwinding point 12' (with a prime, because it is located in the next layer) moves in the direction of the arrow 17. This layer contains the yarn 4 in a counterclockwise helix.

As FIG. 5 clearly shows, the unwinding point 12' completes 2.5 revolutions when it moves from the top end or unwinding end 8 to the bottom end 16, but only about one revolution in moving from the bottom end 16 to the unwinding end 8. The winding ratio, in the instance shown, would be 1 to 2.5. In a departure from the winding ratio shown, still other winding ratios up to 1:10 and preferably 1:5 are conceivable, and depending on the yarn conditions they result in improved values for the unwinding force, compared with cross-wound bobbin in which the winding ratio in the successive layers is 1:1. The term "winding ratio" is understood here to mean the number of windings in which the yarn is wound on along the way from the bottom end to the unwinding end, in proportion to the number of windings that the yarn describes on the trip in reverse.

In other words, the amount of the angle α that the yarn 4 in the layer with the clockwise helix forms with the plane 7 is greater than the amount of the angle β that the yarn 4 in the layer with the counterclockwise helix forms with the yarn 7.

Aside from the difference noted, the cross-wound bobbin 1 of FIG. 5 is produced on the same criteria as usual. Agglomerations of material are to be avoided, and to do so, the turning point 9 both at the unwinding end 8 and at the bottom end 16 is shifted. As random an orientation of the yarn course as possible, relative to the next layer having the same winding direction, is also sought, in order to avoid moiré effects or regularities that cause problems.

Besides the conical shape as shown in FIG. 5, the cross-wound bobbin 1 can also be shaped, by means of suitable winding, in such a way that its cone angle varies as a function of diameter, or that for instance toward the end, i.e. at small diameters, it changes to a cylindrical shape. It would also be conceivable to create a cross-wound bobbin 1 in which the cheese cone 2, adjacent to the unwinding end 8, is initially cylindrical and then changes to a region where it is frustoconical. A hyperboloid is thus approximated.

The cheese cone can also be cylindrical over the full length and through all diameters, as is conventional today.

Findings from a series of experiments demonstrate that the improvement can be shown in table form as follows for the diameter of 100 mm:

| | Pitch ratio | | | |
|---|---|---|---|---|
| | 1:1 Prior art | 1:2 | 1:2.5 | 1:3 |
| Maximum force | 25 cN | 18 cN | 11 cN | 17 cN |
| Standard deviation | ±5 cN | ±4 cN | ±3 cN | ±4 cN |
| Mean value | 6 cN | 5 cN | 3 cN | 5 cN |

For a package diameter of approximately 65 mm, the following relationships pertain:

| | Pitch ratio | | | |
|---|---|---|---|---|
| | 1:1 Prior art | 1:2 | 1:2.5 | 1:3 |
| Maximum force | 35 cN | 18 cN | 15 cN | 12 cN |
| Standard deviation | ±6 cN | ±4 cN | ±3 cN | ±3 cN |
| Mean value | 7 cN | 4 cN | 4 cN | 2 cN |

The angles of inclination α and β can be constant, with the exception of the peripheral regions at the unwinding end 8 and the bottom end 16. However, they can also vary over the axial length, and they can furthermore be dependent on the radial spacing. Finally, it is conceivable to create a conical angle that increases up to the point where the bobbin is full, by providing windings in the interior of the cheese cone, relative to the radial width, that do not have the full axial length; that is, windings are generated that beginning for instance at the bottom end 16 reach only approximately halfway up the cheese cone 2.

The particular shape and angular ratio selected must be ascertained individually by experimentation, because in the process of unwinding the yarn, the type of yarn and the yarn material as well as the yarn diameter all have a very substantial role. Optimization by means of a series of experiments is therefore unavoidable.

In a cross-wound bobbin, the helical lines in which the yarn is wound up have a different inclination in adjacent layers. The winding radios are selected such that the quantity drawn off is greater if the unwinding point is moving from the unwinding end to the bottom end, compared to the quantity drawn off if the unwinding point is moving from the bottom end to the unwinding end.

The invention claimed is:

1. A cross-wound bobbin comprising:

a bobbin core and a cheese cone which is made up of yarn that is applied in layers to the bobbin core with successive layers having increased outward radial positioning from the core, said cheese cone having an unwinding end from which the yarn can be drawn off overend from an unwinding point and an opposite bottom end, said yarn in one of said layers in the cheese cone extending along a first helical line from the unwinding end of the cheese cone to the bottom end of the cheese cone and in an adjacent layer in said cheese cone extending in a second helical line in the opposite winding direction from the bottom end of the cheese cone to the unwinding end of the cheese cone, said first and second helical lines having different pitches relative to a plane perpendicular to an axis of the bobbin core such that in at least one region of the cheese cone the yarn length being unwound is greater if the unwinding point of the yarn on the outside of the cheese cone has moved from the unwinding end of the cheese cone to the bottom end of the cheese cone relative to the yarn length that is drawn off in said at least one region of the cheese cone if the unwinding point of the yarn has moved from the bottom end of the cheese cone to the unwinding end of the cheese cone wherein the relationship of the number of windings in which the yarn is unwound along the way from the bottom end to the unwinding end to the number of windings the yarn is unwound in the reverse direction from the unwinding end to the bottom end defines a winding ratio, and the winding ratios of first and second helical lines of adjacent layers vary in relation to the radial positioning of the layers with respect to the bobbin core.

2. The cross-wound bobbin of claim 1, wherein said at least one region of the cheese cone is a region that extends from a first diameter to a second diameter.

3. The cross-wound bobbin of claim 1, wherein said at least one region of the cheese cone is a region that extends from a first point to a second point that is axially spaced apart from the first point.

4. The cross-wound bobbin of claim 1, wherein the cheese cone includes a second region that is different from said at least one region of the cheese cone that contains a different winding ratio.

5. The cross-wound bobbin of claim 1, wherein the bobbin core is formed by a bobbin tube.

6. The cross-wound bobbin of claim 1, wherein the unwinding end of the cheese cone is free of any coverings.

7. The cross-wound bobbin of claim 1, wherein one yarn layer changes over to a next yarn layer at a turning point and neither at the bottom end of the cheese cone nor at the unwinding end of the cheese cone are successive turning points located directly one above the other.

8. The cross-wound bobbin of claim 7, wherein the successive turning points are offset from one another in the circumferential direction or in the longitudinal direction relative to an axis of the cheese cone.

9. The cross-wound bobbin of claim 1, wherein the cheese cone is shaped such that on successive layers of yarn moiré patterns do not develop.

10. The cross-wound bobbin of claim 1, wherein the cheese cone, at least when fully wound with yarn, is cylindrical.

11. The cross-wound bobbin of claim 1, wherein the cheese cone, at least when fully wound with yarn, tapers conically toward the unwinding end.

12. The cross-wound bobbin of claim 1, wherein the cheese cone is shaped such that a conical cheese cone is formed when the cheese cone is fully wound with yarn and whose shape changes over to a cylindrical shape with increasing yarn removal.

13. The cross-wound bobbin of claim 1, wherein the yarn is made from a yarn selected from the group consisting of spun yarn, monofilament yarn, multifilament yarns, and twisted yarns.

14. The cross-wound bobbin of claim 1, wherein the yarn is wound in one yarn layer at an angle between 30° and 12° measured relative to a plane that is perpendicular to the axis of the cheese cone and the angle at which the yarn is wound in a next yarn layer is between 0.5° and 15° measured relative to said plane.

15. The cross-wound bobbin of claim 1, wherein a winding ratio between winding from the bottom end of the cheese cone to the unwinding end of the cheese cone and winding from the unwinding end of the cheese cone to the bottom end cheese cone is between 1:1.2 and 1:10.

16. The cross-wound bobbin of claim 1, wherein the cheese cone is frustoconical in shape on the unwinding end or on the bottom end.

17. The cross wound bobbin of claim 1, in which the winding ratio of the first and second helical lines of adjacent layers increases as the diameter of the bobbin defined by the layers decreases.

* * * * *